US009434459B2

(12) United States Patent
Solari et al.

(10) Patent No.: US 9,434,459 B2
(45) Date of Patent: Sep. 6, 2016

(54) THERMAL INSULATING BUSHING FOR PISTON FIRST STAGES

(71) Applicants: Franco Solari, Chiavari (IT); Alessandro Cigolini, Casarza Ligure (IT); Corrado Cominetti, Cogorno (IT)

(72) Inventors: Franco Solari, Chiavari (IT); Alessandro Cigolini, Casarza Ligure (IT); Corrado Cominetti, Cogorno (IT)

(73) Assignee: Johnson Outdoors Inc., Racine, WI (US)

( * ) Notice: Subject to any disclaimer, the term of this patent is extended or adjusted under 35 U.S.C. 154(b) by 133 days.

(21) Appl. No.: 14/207,874

(22) Filed: Mar. 13, 2014

(65) Prior Publication Data

US 2015/0259057 A1 Sep. 17, 2015

(51) Int. Cl.
*F16K 31/12* (2006.01)
*B63C 11/22* (2006.01)

(52) U.S. Cl.
CPC ..... *B63C 11/2209* (2013.01); *Y10T 137/0318* (2015.04); *Y10T 137/7793* (2015.04); *Y10T 137/7808* (2015.04)

(58) Field of Classification Search
CPC ..... Y10T 137/2036; Y10T 137/7808; Y10T 137/7811
USPC ..... 128/204.29, 205.24; 251/337
See application file for complete search history.

(56) References Cited

U.S. PATENT DOCUMENTS 3,890,999 A * 6/1975 Moskow ..... 137/505.25
4,230,140 A * 10/1980 Hart ..... 137/81.2
5,190,030 A 3/1993 Semeia
5,381,825 A * 1/1995 Garraffa ..... 137/505.18
5,507,308 A * 4/1996 Chambonnet ..... 137/81.2
5,685,297 A * 11/1997 Schuler ..... 128/205.24
5,775,368 A * 7/1998 Morino ..... 137/505.25
6,725,861 B1 4/2004 Semeia
2002/0088495 A1* 7/2002 Semeia ..... 137/505.25
2003/0221726 A1* 12/2003 Semeia ..... 137/338
2005/0016537 A1 1/2005 Pedemonte
2008/0105308 A1* 5/2008 Garraffa ..... 137/505.18
2008/0236587 A1 10/2008 Semeia
2011/0057138 A1* 3/2011 Maus et al. ..... 251/357
2013/0266465 A1* 10/2013 Akita et al. ..... 417/443

FOREIGN PATENT DOCUMENTS

EP 0 503 300 A2 9/1992
EP 0 811 549 A2 12/1997
EP 1200305 A1 5/2002
JP 2010-287337 * 12/2010

* cited by examiner

*Primary Examiner* — R. K. Arundale
(74) *Attorney, Agent, or Firm* — Reinhart Boerner Van Deuren P.C.

(57) ABSTRACT

A first stage pressure regulator is provided. The regulator includes a valve body having an inlet and an outlet coupled by a pressure chamber. A pressure compensation chamber fluidly communicates with the surrounding water. A valve member is slidably carried by the valve body between an open state in which fluid is permitted to flow between the inlet and outlet and a closed state in which fluid is prevented from flowing between the inlet and outlet. The valve member has an expansion head that is operably acted upon by the surrounding water within the pressure compensation chamber to bias the valve member toward the open state. The regulator includes an annular insulating bushing within the compensation chamber that covers a portion of the valve body defining a portion of the pressure compensation chamber to insulate the valve body from the water within the pressure compensation chamber.

15 Claims, 1 Drawing Sheet

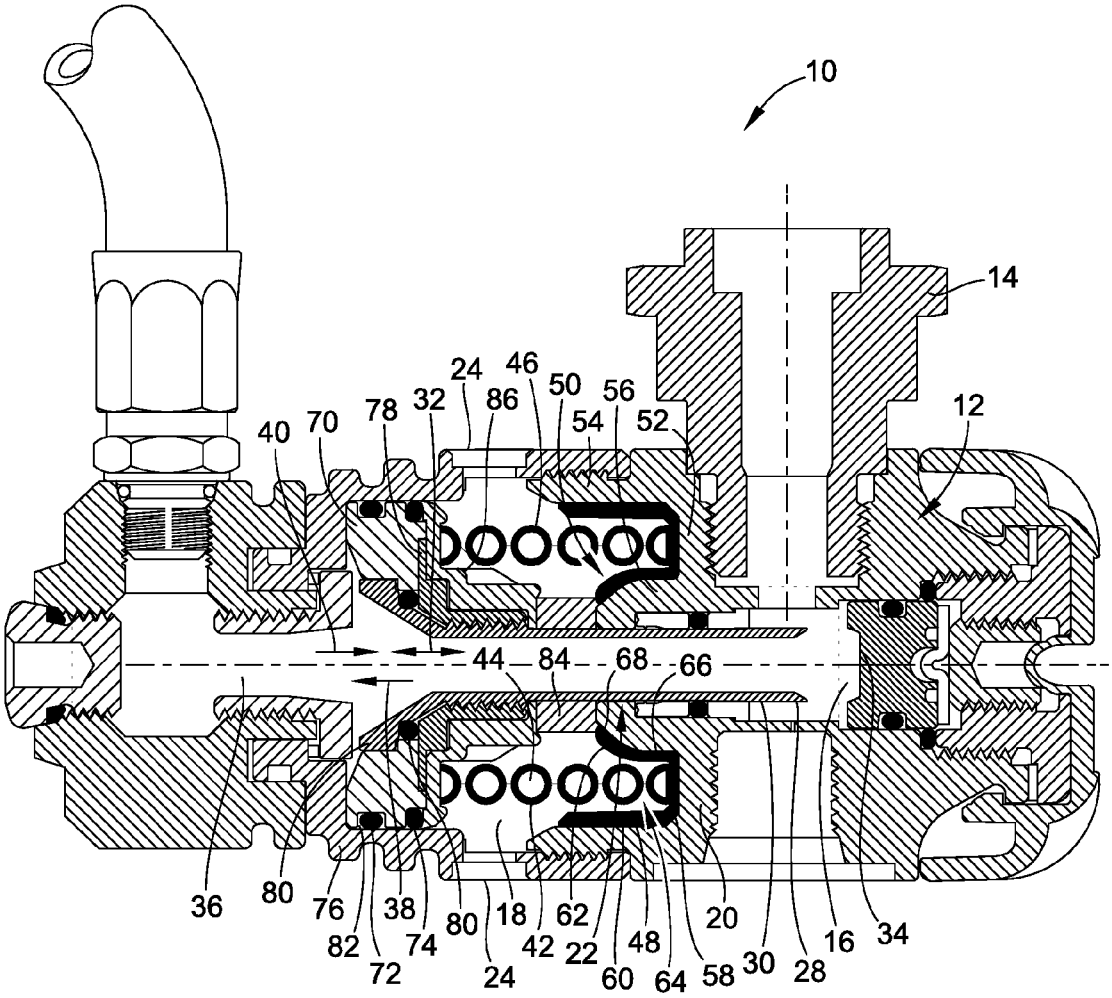
10
14
12
24
46
50
56
86
32
78
70
40
54
52
44
84
68
66
36
80
76
82
72
38
74
80
24
18
42
62
22
60
64
48
58
20
30
28
16
34

THERMAL INSULATING BUSHING FOR PISTON FIRST STAGES

FIELD OF THE INVENTION

This invention generally relates to a regulatory valve for use in a self-contained underwater breathing apparatus.

BACKGROUND OF THE INVENTION

Safely delivering breathable air to divers in a cold water environment presents challenges. Pressure regulators for underwater breathing convert high pressure gas to a lower pressure that are at or closer to a pressure that can be breathed by the diver.

First stage reduction of suitable gas for breathing typically incorporates pressure compensation for adjusting the pressure of the gas output from the pressure regulator based on the depth of the diver within the water. As a diver goes deeper in the water, the pressure compensation will increase the pressure of the gas being output from the regulator.

To provide pressure compensation, many regulators include a pressure compensation chamber that receives and fluidly communicates with the water surrounding the diver, and particularly the regulator. The water within the pressure compensation chamber will act on a moving mechanism that is biased in one direction by a spring and the ambient water and biased in an opposite direction by the gas being regulated and output by the regulator. As the surrounding water pressure increases, the force of the water on the moving mechanism also increases which creates an increased output pressure of the gas exiting the pressure regulator.

Unfortunately, the process of reducing the pressure of the gas from the inlet pressure to the outlet pressure is an adiabatic process that absorbs heat energy from the surrounding environment, namely the surrounding water.

In cold water dives, the temperature of the water can be near freezing. The adiabatic process of the pressure regulator can result in localized freezing of the surrounding water on the exposed surfaces of the regulator. If the water within the pressure compensation chamber freezes, the ice can affect the motion and operation of the moving mechanism and the spring.

The present invention seeks to provide improvements over the current state of the art of underwater pressure regulators for underwater breathing devices.

BRIEF SUMMARY OF THE INVENTION

In one aspect, the invention provides a first stage pressure regulator comprising a valve body that has an inlet and an outlet. The valve body defines a pressure chamber between the inlet and an outlet. The valve body further defines a pressure compensation chamber that has an opening. The opening fluidly communicates the pressure compensation chamber with the surrounding water.

The first stage pressure regulator further comprises a valve seat within the valve body and a valve member. The valve member is slidably carried within the valve body pressure chamber. The valve member has a valve end. An expansion head is connected to the valve end. The valve member is slidable between an open state and a closed state. In the open state the valve end is spaced from the valve seat and permits fluid flow between the inlet and outlet. In the closed state the valve end is sealingly seated against the valve seat to prevent fluid flow between the inlet and outlet. The expansion head is exposed to the pressure compensation chamber and is operably acted upon by the surrounding water within the pressure compensation chamber to bias the valve member toward the open state.

The first stage pressure regulator is further comprised of an annular insulating bushing within the compensation chamber. The annular insulating bushing covers a portion of the valve body that defines a portion of the pressure compensation chamber. A biasing member is interposed between the annular insulating bushing and the expansion head to bias the valve member towards an open state.

The valve body defines an annular mounting groove that forms part of the pressure compensation chamber. The annular insulating bushing is positioned within the annular mounting groove.

The annular insulating bushing generally includes a base portion, an outer radial sidewall and an inner radial sidewall portion. The outer radial sidewall portion extends from the base portion. The inner radial sidewall portion extends from the base portion and radially inward of the outer radial sidewall portion. The base portion, inner radial sidewall portion and outer radial sidewall portion of the annular insulating bushing define an annular receiving groove that receives an end of the biasing member.

The annular mounting groove is defined by a radially outer surface portion, a base surface portion and a radially inner surface portion formed by the valve body. The outer radial sidewall portion overlaps with and insulates the radially outer surface portion from the water within the compensation chamber. The inner radial sidewall portion overlaps with and insulates the radially inner surface portion from the water within the compensation chamber. The base surface portion overlaps with and insulates the base portion from the water within the pressure compensation chamber.

The valve member of the first stage pressure regulator extends through and is concentric with the biasing member. The annular insulating bushing is formed from a thermal insulating plastic material. The portion of the valve body that is covered by the annular insulating material is formed from a metal material. The annular insulating bushing's inner radial sidewall portion has a first portion connected to the base portion that is generally parallel to the outer radial sidewall portion and a second portion that is canted relative to the first portion and defines the distal end of the inner radial sidewall portion. The canted portion is canted radially inward when moving away from the base portion.

In other embodiments the annular insulating bushing's inner radial sidewall portion has a first portion connected to the base portion that is generally parallel to the outer radial sidewall portion and a second portion that is canted relative to the first portion and defines the distal end of the inner radial sidewall portion. The canted portion is canted radially inward when moving away from the base portion. The radially inner surface portion has a first portion that is parallel to the radially outer surface portion and a second portion that is canted relative to the first portion to mate with the inner radial sidewall portion of the annular insulating bushing.

Another aspect of the present invention is directed toward a method of inhibiting the freezing of water within a pressure compensation chamber of a first stage pressure regulator. The first stage pressure regulator has a valve body having an inlet and an outlet. The valve body defines a pressure chamber between the inlet and an outlet. The valve body further defines a pressure compensation chamber. The pressure compensation chamber has an opening that fluidly communicates the pressure compensation chamber with the surrounding water. The first stage pressure regulator has a valve member slidably carried within the valve body pressure chamber that is slidable between an open and closed state. In the open state fluid is permitted to flow between the inlet and outlet. In the closed state fluid is prevented from flowing between the inlet and outlet. The valve member has an expansion head that is exposed to the pressure compensation chamber. The valve member is operably acted upon by the surrounding water within the pressure compensation chamber to bias the valve member toward the open state. The pressure regulator has a biasing member acting on the valve member to bias the valve member towards the open state.

The method comprises covering a portion of the valve body that defines a portion of the pressure compensation chamber with an annular insulating bushing positioned within the compensation chamber. The annular insulating bushing is sized and shaped to closely mate with the surfaces of the portion of the valve body that are covered by the annular insulating bushing. The valve body defines an annular mounting groove in which the annular insulating bushing is mounted. The step of covering includes covering the surfaces of the valve body that define the mounting groove with corresponding portions of the annular insulating bushing.

BRIEF DESCRIPTION OF THE DRAWINGS

The accompanying drawing incorporated in and forming a part of the specification illustrates several aspects of the present invention and, together with the description, serves to explain the principles of the invention. In the drawing:

FIG. 1 illustrates an axial section of an embodiment of the valve according to the present invention with the valve member in an open position.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

FIG. 1 illustrates a first stage air pressure reduction valve 10 of a two stage system. The first stage air pressure reduction valve 10 may also be referred to as first stage pressure regulator 10 or even more simply as pressure regulator 10. The first stage pressure regulator 10 is used to reduce the pressure of high pressure gas stored, typically, in a tank carried by a diver to a more manageable pressure that is used by a second stage regulator that supplies breathing gas to the diver.

The pressure regulator 10 generally includes a valve body 12. In the illustrated embodiment, the valve body 12 is generally a two piece valve body having two components attached to one another. In this embodiment, the pieces are threadedly connected to one another.

The valve body 12 is joined to a supply of compressed air (not shown), such as a cylinder of compressed air, by of an inlet tubular union 14 attached to an inlet of the valve body 12. The compressed air may be a mixture of oxygen and other suitable gases for cold water diving. For simplicity hereinafter the air or gas mixture will be referred to as gas.

The valve body 12 provides a pressure chamber 16 and a compensation chamber 18. The pressure chamber 16 and compensation chamber 18 are concentric and coaxial. The pressure chamber 16 and compensation chamber 18 are separated from one another by a partition wall 20 and a valve member 22 that is movable.

The pressure chamber 16 communicates via the inlet tubular union 14 with the pressurized gas supplied into the pressure regulator 10 from the cylinder of compressed gas. The compensation chamber 18 communicates with the outside ambient water through openings 24 in the valve body 12. During a dive, the compensation chamber 18 fills with water at a pressure corresponding to the dive depth.

The valve member 22 is slidingly carried within the valve body 12. The valve member 22 has an expansion head 26 that is connected to a valve end 28 by a tubular stem 30. The tubular stem 30 and expansion head 26 are both sealed to the valve body 12 to prevent ingress of ambient water or egress of the gas within the regulator. The tubular stem 30 and expansion head 26 are also allowed to slide axially within the valve body 12 as illustrated by arrow 32 so as to allow the pressure regulator 10 to reduce the pressure of the gas from its inlet pressure.

The tubular stem 30 is preferably a metal material such as stainless steel to ensure a better resistance both mechanically and chemically (saline, etc.). In this embodiment, the tubular stem 30 defines the valve end 28.

The valve end 28 is tapered in the shape of a spout or funnel. The valve end 28 selectively seats against valve seat 34. When the valve end 28 is spaced away from valve seat 34, the pressure regulator is in an open state and gas is allowed to flow through the pressure regulator 10 from the inlet 14 to an outlet 36 of the pressure regulator 10. This configuration is illustrated in FIG. 1. When the valve end 28 is biased against the valve seat 34, the fluid flow path between the inlet 14 and outlet 36 is closed preventing fluid flow.

The valve seat 34 is preferably of a non-metallic material so as to provide a good sealing engagement with the valve end 28 when the valve member 22 is in a closed state.

The expansion head 26 is at an opposite end of the valve member 22 and has an enlarged conical shape. This conical shape provides an enlarged area in which the gas is allowed to expand. The exterior surfaces of the expansion head are acted on by the water within the compensation chamber 18 to bias the valve member 22 toward the open state (e.g. in the direction of arrow 38). The interior surfaces of the expansion head 26 are acted on by the gas sealed within the pressure regulator 10 to bias the valve member 22 towards the closed state (e.g. in the direction of arrow 40).

A coil spring 42 is located within the compensation chamber 18 to bias the valve member 22 toward the open state (e.g. in the direction of arrow 38) with a minimum predetermined amount of force. The coil spring 42 is interposed between the expansion head 26 and the valve body 12, and particularly a portion of the partition wall 20. The coils of the spring 42, in this embodiment, are formed by a stainless steel core 44 covered by a thermal insulating material layer 46.

The expansion head 26 of the valve member 22 communicates with the outlet 36 of the pressure regulator 10. As gas flows from the inlet 14 to the outlet 36 through the valve member 22, the gas is allowed to expand and drop in pressure. This expansion and pressure drop is an adiabatic process that draws heat energy out of the components of the pressure regulator 10 that surround the pressure chamber 16, such as the valve body 12 and the valve member 22.

Because of the adiabatic gas expansion, the compensation chamber 18 is subjected to a great temperature drop which can cause freezing of the water within the compensation chamber 18. Ice formation within the compensation chamber 18 can affect the operation of coil spring 42, valve member 22 or the openings 24 and inhibit the pressure compensation feature of the pressure regulator 10.

One particular location where freezing occurs is proximate the end of the coil spring 42 that is pressed against the valve body 12. To address the freezing problems within the chamber 18, the illustrated embodiment includes a thermally insulating bushing 48 that covers the outer surfaces of the valve body 12 proximate the location where the coil spring 42 is supported.

The thermally insulating bushing 48 is interposed between the coil spring 42 and the valve body 12. The thermally insulating bushing 48 is received in an annular mounting groove 50 defined by the valve body 12. The annular mounting groove 50 is bound by portions of the valve body 12 including a base portion 52, a first radially outer leg portion 54, and a second radially inner leg portion 56 which combine to form a generally U-shaped cross-section. The thermally insulated bushing 48 seats within the annular mounting groove 50 against the exposed surfaces of the base portion 52, radially outer leg portion 54 and the radially inner leg portion 56 and prevent exposure of the ambient water within the compensation chamber 18 to the potentially cold surfaces of the valve body 12 defining the mounting groove 50.

The thermally insulated bushing 48 is shaped and sized to mate with the inner surfaces of the valve body that define annular mounting groove 50. As such, the thermally insulated bushing 48 is annular and includes a bottom portion 58 that mates with the exposed surface of base portion 52; a first radially outer sidewall portion 60 that mates with the exposed surface of the radially outer leg portion 54; and a second radially inner sidewall portion 62 that mates with the radially inner leg portion 56. The bottom portion 52 connects the sidewall portions 60, 62 to one another. The sidewall portions 60, 62 extend outward from a same side of the bottom portion 58. The sidewall portions 60, 62 are radially spaced from one another to form an annular receiving groove 64 that receives one end of coil spring 42.

In the illustrated embodiment, the radially outer sidewall portion 60 is a generally straight member. The radially inner sidewall portion 62 has two sections including a straight section 66 and a conical section 68 that is tapered relative to the straight section. The straight section 66 is interposed between the conical section 68 and the bottom portion 58. These portions mate with corresponding portions of the exposed surface of the radially inner leg portion 56.

The thermally insulated bushing 48 may be press fit, friction fit, glued, or mechanically secured within the annular mounting groove 50.

The thermally insulated bushing 48 is preferably made of thermal insulating plastic material, which can also include a suitable filling material, such as for instance empty microspheres embedded in the plastic to improve the thermal insulation and inhibit heat transfer from the water within the compensation chamber to the valve body 12 and pressure regulator 10, generally. The thermally insulated bushing 48 attempts to force the adiabatic expansion process to draw heat energy from a different location and source of energy other than the water within the compensation chamber 18.

Additional insulation may be provided by thermally insulating the annular part 70 of the expansion head 26 that is acted upon by the water within the compensation chamber 18. The annular part 70 of the expansion head 26 carries on its outer radial periphery a first watertight main ring (O-ring) 72 and a second ring 74. Lubrication is provided in the compartment formed between said rings 72 and 74 and the side wall 76 of the compensation chamber 18.

A threaded bushing 78 is provided to hold together the annular part 70 to the stem 30. The threaded bushing 78 is screwed to stem 30, which is externally threaded as well. Moreover, a further watertight ring 80 is interposed between the threaded bushing 78 and the stem 30. Main watertight ring 72 is set in a groove 82 having a width greater than that of the ring 72 itself, so that it is slightly movable relative to the expansion head 26 when performing its opening or closing stroke, further improving the lubrication of the parts in motion. Alternative embodiments may use a single O-ring. In yet other embodiments, threaded bushing 78, annular part 70 and stem 30 may be formed from one or more pieces.

In addition to the insulation provided by annular part 70, stem 30 is provided with thermal insulation means comprised of sheath 84 on the stem 30 before the threaded section of the stem 30, made of compressible thermally insulating material. When the valve member 22 is in its open state the sheath 84 is stretched in its natural position, while when the valve member 22 is in a closed position the sheath 84 is compressed. Additional insulation is provided with a further bushing 86 of thermal insulating material placed around the threaded bushing 78 and projecting against the annular part 70 of the expansion head 26 of the valve member 22.

Because of the thermally insulated bushing 48 and the other described insulating means, heat transfer from the water within the compensation chamber 18 is reduced which inhibits freezing of the water within the pressure compensation chamber 18 during cold water dives, at least for the length of time of a normal diving, thus avoiding the inefficiency or the eventual valve blocking and the connected risks for the user. Further, with thermal insulated bushing 48 insulating in cooperation with bushing 86, threaded insulated bushing 78 insulating material layer 46 and sheath 84 the surfaces exposed to the ambient water (also referred to as the "wet area") of compensation chamber 18 are substantially insulated. In some embodiments more than 80% of the surfaces in compensation chamber 18 are insulated and in yet other embodiments at least 90% of the surfaces in compensation chamber 18 are insulated.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A first stage pressure regulator comprising:

a valve body having an inlet and an outlet and defining a pressure chamber between the inlet and the outlet, the valve body defining a pressure compensation chamber having an opening fluidly communicating the pressure compensation chamber with a surrounding water;

a valve seat within the valve body;

a valve member slidably carried within the valve body pressure chamber having a valve end and an expansion head connected to the valve end, the valve member slidable between an open state in which the valve end is spaced from the valve seat and that permits fluid flow between the inlet and outlet and a closed state in which the valve end is sealingly seated against the valve seat and that prevents fluid flow between the inlet and outlet, the expansion head being exposed to the pressure compensation chamber and being operably acted upon by the surrounding water within the pressure compensation chamber to bias the valve member toward the open state;

an annular insulating bushing within the compensation chamber and covering a portion of the valve body defining a portion of the pressure compensation chamber; and a biasing member interposed between the annular insulating bushing and the expansion head to bias the valve member towards the open state.

2. The first stage pressure regulator of claim 1, wherein the valve body defines an annular mounting groove that forms part of the pressure compensation chamber, the annular insulating bushing being positioned within the annular mounting groove.

3. The first stage pressure regulator of claim 2, wherein:

the annular insulating bushing generally includes a base portion, an outer radial sidewall portion extending from the base portion, an inner radial sidewall portion extending from the base portion and radially inward of the outer radial sidewall portion;

the base portion, inner radial sidewall portion and outer radial sidewall portion defining an annular receiving groove that receives an end of the biasing member.

4. The first stage pressure regulator of claim 3, wherein:

the annular mounting groove is defined by a radially outer surface portion, a base surface portion and a radially inner surface portion formed by the valve body;

the outer radial sidewall portion overlapping with and insulating the radially outer surface portion from the water within the compensation chamber;

the inner radial sidewall portion overlapping with and insulating the radially inner surface portion from the water within the compensation chamber; and the base surface portion over lapping with and insulating the base portion from the water within the pressure compensation chamber.

5. The first stage pressure regulator of claim 1, wherein the valve member extends through and is concentric with the biasing member.

6. The first stage pressure regulator of claim 1, wherein the annular insulating bushing is formed from a thermal insulating plastic material.

7. The first stage pressure regulator of claim 1, wherein the portion of the valve body that is covered by the annular insulating material is formed from a metal material.

8. The first stage pressure regulator of claim 3, wherein the inner radial sidewall portion has a first portion connected to the base portion that is generally parallel to the outer radial sidewall portion and a second portion that is canted relative to the first portion and that defines the distal end of the inner radial sidewall portion.

9. The first stage pressure regulator of claim 8, wherein the canted portion cants radially inward and extends in a direction away from the base portion towards the outlet.

10. The first stage pressure regulator of claim 4, wherein the inner radial sidewall portion has a first portion connected to the base portion that is generally parallel to the outer radial sidewall portion and a second portion that is canted relative to the first portion and that defines the distal end of the inner radial sidewall portion.

11. The first stage pressure regulator of claim 10, wherein the canted portion cants radially inward and extends in a direction away from the base portion towards the outlet.

12. The first stage pressure regulator of claim 11, wherein the radially inner surface portion has a first portion that is parallel to the radially outer surface portion and a second portion that is canted relative to the first portion to mate with the inner radial sidewall portion of the annular insulating bushing.

13. A method of inhibiting freezing of water within a pressure compensation chamber of a first stage pressure regulator, the first stage pressure regulator having a valve body having an inlet and an outlet, the valve body defining a pressure chamber between the inlet and an outlet, the valve body defining the pressure compensation chamber and having an opening fluidly communicating the pressure compensation chamber with the surrounding water, the first stage pressure regulator having a valve member slidably carried within the valve body pressure chamber slidable between an open state in which fluid is permitted to flow between the inlet and outlet and a closed state in which fluid is prevented from flowing between the inlet and outlet, the valve member having an expansion head being exposed to the pressure compensation chamber and being operably acted upon by the surrounding water within the pressure compensation chamber to bias the valve member toward the open state, the pressure regulator having a biasing member acting on the valve member to bias the valve member towards the open state, the method comprising:

covering a portion of the valve body defining a portion of the pressure compensation chamber with an annular insulating bushing positioned within the compensation chamber.

14. The method of claim 13, wherein the annular insulating bushing is sized and shaped to closely mate with the surfaces of the portion of the valve body that are covered by the annular insulating bushing.

15. The method of claim 14, wherein the valve body defines an annular mounting groove in which the annular insulating bushing is mounted, the step of covering including covering the surfaces of the valve body that define the mounting groove with corresponding portions of the annular insulating bushing.

* * * * *